US005737820A

United States Patent [19]

Ferrari et al.

[11] Patent Number: 5,737,820

[45] Date of Patent: Apr. 14, 1998

[54] TOOL FOR CLAMPING RUNNERS ONTO DRAWERS

[75] Inventors: Franco Ferrari, Frazione Deviscio, 2, 22053 Lecco; Carlo Migli, Lecco, both of Italy

[73] Assignee: Franco Ferrari

[21] Appl. No.: 646,215

[22] Filed: May 7, 1996

[30] Foreign Application Priority Data

May 12, 1995 [IT] Italy ..... MI950323 U
Jan. 19, 1996 [IT] Italy ..... MI960035 U

[51] Int. Cl.[6] ..... B23P 11/00

[52] U.S. Cl. ..... 29/243.5; 29/283.5; 269/234; 269/238

[58] Field of Search ..... 269/234, 238; 72/325; 29/243.5, 283.5

[56] References Cited

U.S. PATENT DOCUMENTS

| | | | |
|---|---|---|---|
| 747,833 | 12/1903 | Alger et al. | 269/234 |
| 1,733,773 | 10/1929 | Benedict | 269/234 |
| 2,850,926 | 9/1958 | Jobe | 269/234 |
| 3,170,322 | 2/1965 | Cavanaugh | 269/234 |
| 3,877,280 | 4/1975 | Cornell . | |
| 4,571,975 | 2/1986 | Pawloski et al. . | |
| 5,375,312 | 12/1994 | Sakurai et al. . | |

FOREIGN PATENT DOCUMENTS

| | | |
|---|---|---|
| 722160 | 1/1955 | United Kingdom . |
| 1123634 | 8/1968 | United Kingdom . |

*Primary Examiner*—Robert C. Watson
*Attorney, Agent, or Firm*—Shlesinger, Fitzsimmons & Shlesinger

[57] ABSTRACT

A clamping tool designed for clamping sheet metal runners onto the side panels of drawers comprises an elongated grippable casing, at one end of which is a clamp (27, 127) composed of a pair of jaws (20, 21, 121) designed to grip a clamping area of a runner clasping the edge of a side panel of the drawer. Inside the casing is a actuator (18, 118) for moving a wedge-shaped element (19, 119). At least one jaw (21, 121) of the pair is made on the extremity of a lever (22, 122) having its other extremity (24, 124) slidingly resting on the wedge-shaped element (19, 119). Upon actuation of the actuator, the wedge (19, 119) slides over the extremity (24, 124) of the lever (22, 122) to rotate it around a pivot (23, 123) lying between the extremities and shift the jaws towards each other.

8 Claims, 2 Drawing Sheets

TOOL FOR CLAMPING RUNNERS ONTO DRAWERS

BACKGROUND OF THE INVENTION

This invention refers to a tool for manually clamping slide runners onto the side panels of drawers. In the known technique there are runners for drawers which have a portion to be fitted over the lower edge of the side panel of the drawer with tabs disposed parallel to the wall of the side panel to be folded and pressed against the wall so as to clamp the runner onto the drawer. Said runners are described in the European patent EP-A-0 520 539.

The general scope of this invention is to provide a tool for manually clamping similar sliding runners onto the side panels of drawers, which is of limited dimensions for easy handling and at the same time enables the runners to be quickly and accurately clamped.

SUMMARY OF THE INVENTION

This scope is achieved according to the invention by providing a clamping tool designed for clamping sheet metal runners onto the side panels of drawers, comprising a clamp composed of a pair of jaws designed to grip a clamping area of a runner clasping the edge of a side panel of the drawer, and an actuator pushing a wedge-shaped element toward the clamp, at least one jaw of the pair being made on the extremity of a lever having its other extremity slidingly resting on the wedge-shaped element, upon actuation of the actuator the wedge element sliding over said other extremity of the lever to rotate it around a pivot lying between the extremities and shift the jaws towards each other.

BRIEF DESCRIPTION OF THE DRAWINGS

The innovative principles of this invention and its advantages with respect to the known technique will be more clearly evident from the following description of possible exemplificative and non-restrictive embodiments applying such principles, with reference to the accompanying drawings, in which.

DETAILED DESCRIPTION OF THE INVENTION

Figure 1:
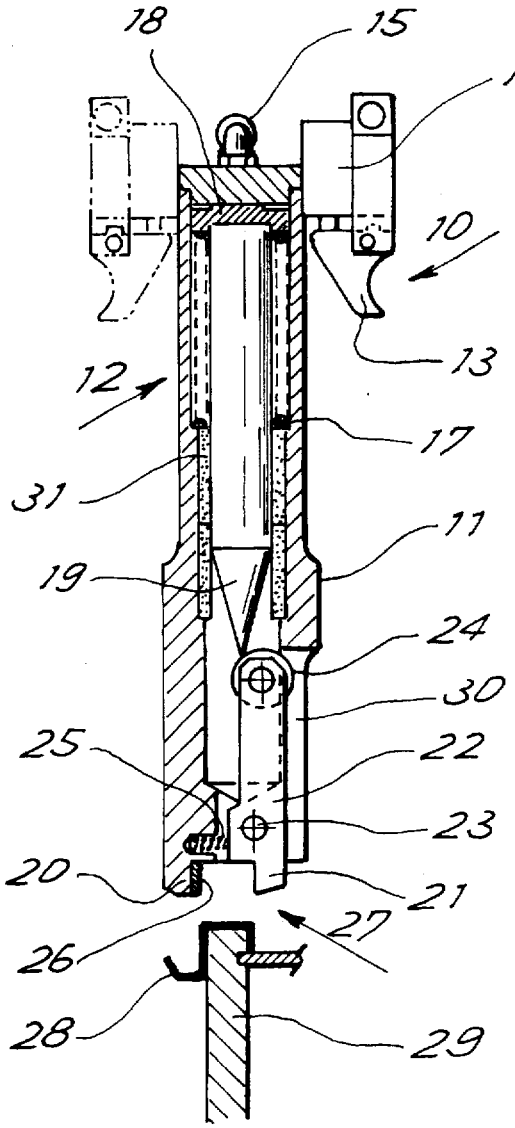
FIG. 1 shows a longitudinal cutaway view of a tool according to the invention, shown in the non-operative position.

The FIGS. 1–4 show a tool, generically indicated by reference 10, comprising a generically cylindrical casing 11, defining a gripping area or extremity 12 of a diameter suitable for gripping by the operator so that the index finger of the hand rests upon a trigger 13.

The trigger 13 controls a valve 14 to introduce compressed air, conveyed through a feed duct 15, into a piston chamber 16 made in the hollow interior of the tool casing.

Sliding within the chamber 16, against the action of a counter spring 17 is a plunger 18 which has a shank ending outside the chamber 16 with one wedge-shaped tapered end 19. The shank slides on low-friction guides 31. At one top end, the tool has a first fixed jaw 20, machined from the casing of the tool, and a second movable jaw 21 facing the first to form a clamp 27 which is capable of gripping and clamping a runner guide 28 onto a side panel of a drawer 29, both shown schematically since they are well known to the expert in the field. The movable jaw 21 is at the end of a lever 22 pivoted by 23 to the casing of the tool and which ends with a wheel which runs over the wedge 19.

A spring 25 pushes the lever towards the open position of the jaws shown in FIG. 1.

Advantageously, the lever 22 is received in the casing of the tool in correspondence with a groove 30 which is open in the plane of rotation of the lever, so that the jaw 21 end of the lever can be clearly seen by the operator and does not obstruct the view of the working area.

The fixed jaw 20 also advantageously has a plate that is interchangable with other similar elements but of a different thickness, so as to enable the clamp to adapt to different clamping apertures, that is to say to different thicknesses of the side panel and runner assembly.

Figure 2:
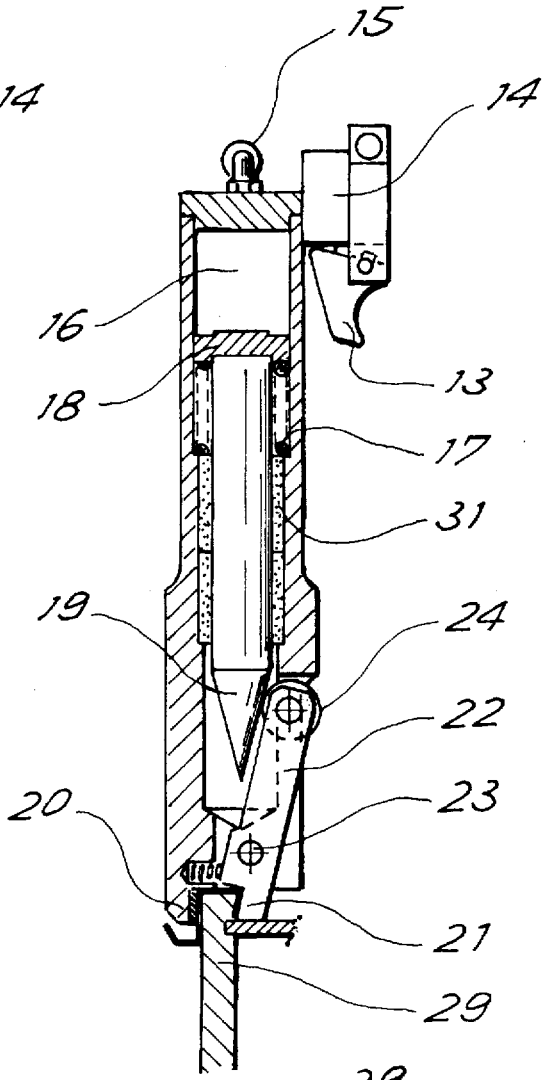
FIG. 2 shows a view similar to that of FIG. 1 but with the tool in the clamping position.
Figure 3:
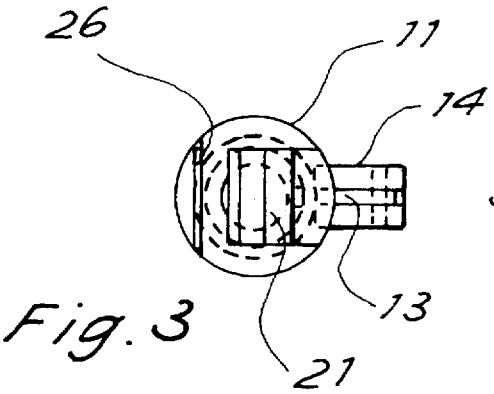
FIG. 3 shows a view from a top end of the tool of FIG. 1.
Figure 4:
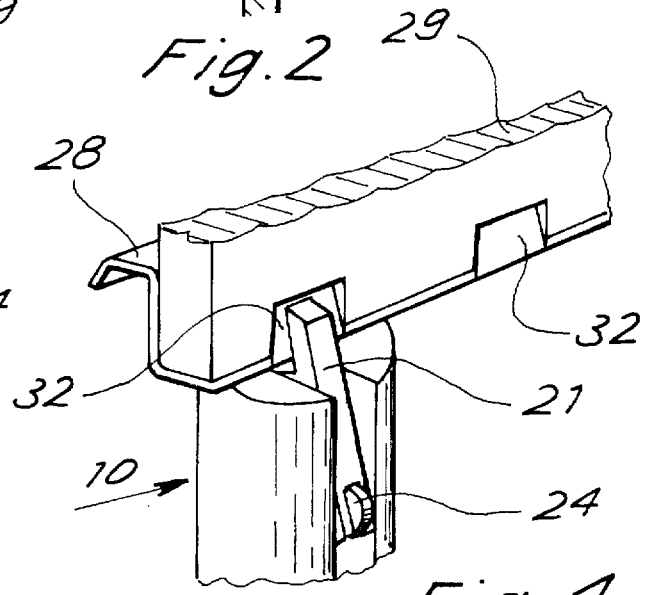
FIG. 4; shows a schematic view of a runner clamped with the tool of FIG. 1.

As shown in FIG. 2, when the trigger 13 is pressed the plunger 18 moves forward against the thrust of the spring 17 and the wedge 19 rotates the lever 22 so that the movable jaw clamps the lip of the runner to the side panel of the drawer.

The clamp 27 must be placed on the runner so that the movable jaw clasps the lip to be folded over the drawer placed upside down. Thanks to the rotatory movement of the lever 22, the jaw 21 slopes towards the fixed jaw 20 and in this way the clamping lips or tabs 32 for clamping the runners are slanted towards the wall of the side panel and bite into the side panel, as can be clearly seen in FIG. 4, thereby remaining firmly fastened. At the same time, the fixed jaw remains parallel to the wall of the runner on which it rests and consequently does not ruin its surface.

It is obvious that with a tool according to the invention it is possible to rapidly clamp a runner, by easily shifting the tool between the tabs to be folded for the complete clamping of the runner. Thanks to the mechanism with lever and wedge, the tool is extremely powerful and has a very limited cross-section, so as to offer a comfortable grip and a clear visibility of the working area.

Moreover, the very limited number of parts makes the tool inexpensive and extremely robust.

Figure 5:
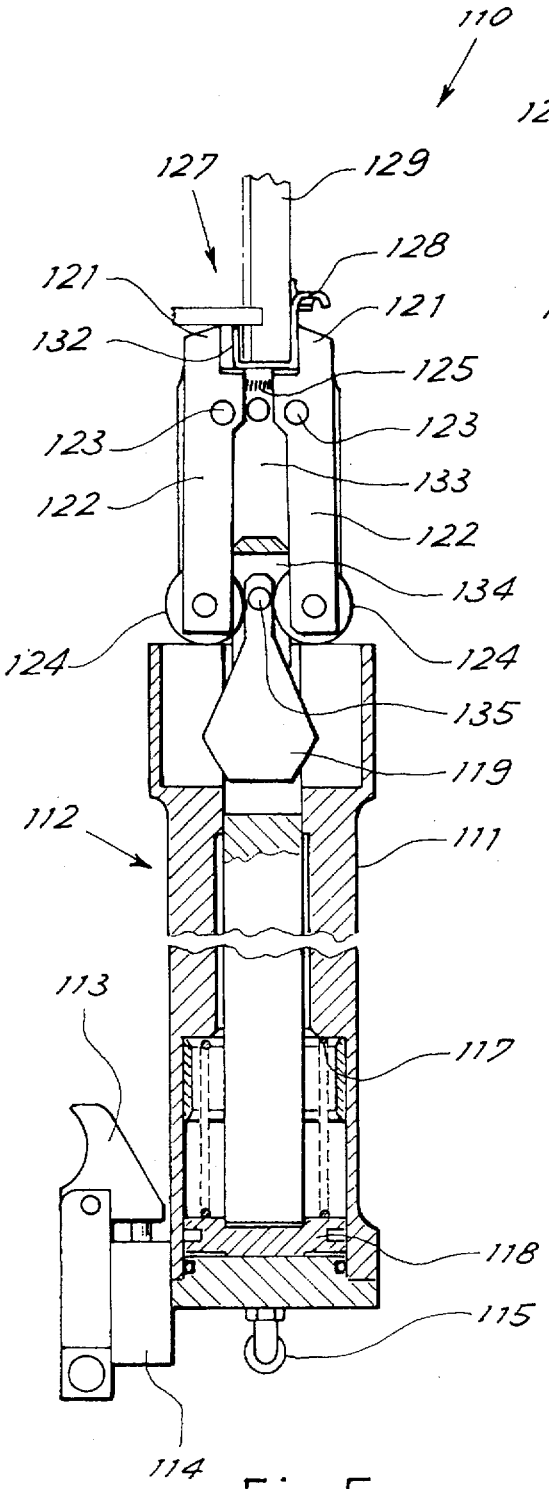
FIG. 5 shows a partial cutaway view of second embodiment of a tool according to the invention.

FIG. 5 shows a second embodiment of a tool according to the invention.

The tool, generically indicated by reference 110, comprising a generically cylindrical casing 111, identifying a gripping area or end 112 with a diameter suitable to be gripped by the hand of the operator in such a way that the index finger of the hand comes to rest upon a trigger 113.

The trigger 113 controls a valve 114 to introduce compressed air, conveyed through a feed duct 115, to operate, against the action of a spring 117, an actuator composed of a plunger 118 which operates the tool. At a top end, the tool has a pair of movable jaws 121 facing each other to form a clamp 127 capable of gripping and clamping a runner guide 128 onto a side panel of a drawer 129, both shown schematically since they are well known to the expert in the field.

Each movable jaw 121 is at the end of a lever 122 pivoted by a pin 123 to a support 133 composed of two shoulders disposed face to face on casing 111 to support the two levers between them (only one of the shoulders being visible in the figure). Each lever 122 ends at the other extremity with a wheel or roller 124 which runs over lateral surfaces of a wedge-shaped element 119 carried by the shank of plunger 118 to fit between the extremities of the levers and spread them apart.

A spring 125 pushes the levers 122 towards the open position of the jaws shown in FIG. 5.

Figure 6:
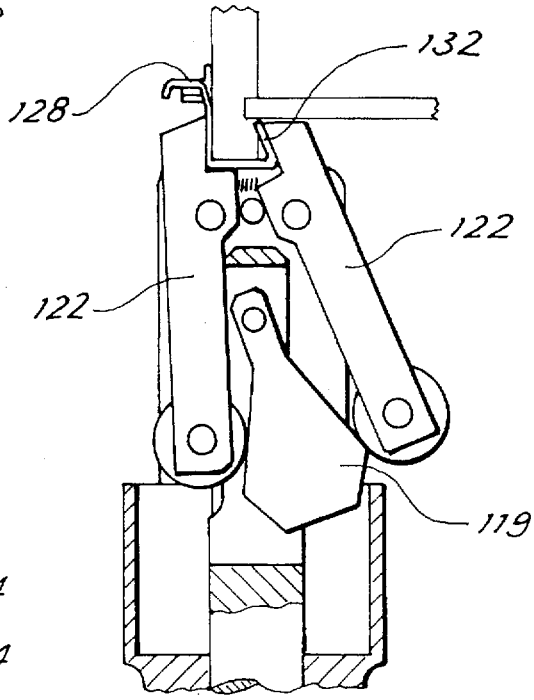
FIG. 6 shows a partial cutaway view of the clamping head of the tool of FIG. 5 in a first operative position.

As shown in FIG. 6, when the trigger 113 is pulled, the plunger 118 moves forward against the thrust of the spring 117 and the wedge 119 pushes the extremities of the levers 122 bearing the wheels 124 away from each other.

According to the invention, for the reasons that will be clear further on, a relative movement is possible between the lateral surfaces of the wedge and support 133 of the levers, crosswise to the tool and in the plane of rotation of the levers.

For example, such relative movement can be obtained by making the wedge 119 freely movable in a crosswise or lateral direction to the reciprocable movement with which it fits between the levers and in the plane of movement of the levers, while the support 133 can be integral with the casing of the tool. Advantageously, this movement of the wedge can be achieved by pivoting the wedge 119 on a pin 135 mounted in an opening in a sliding element 134 operated by the shank of the plunger. The wedge can thus swing in the plane of rotation of the levers 122, as shown in the figures. The sliding element 134 can be a simple extension of the shank of the plunger.

Figure 7:
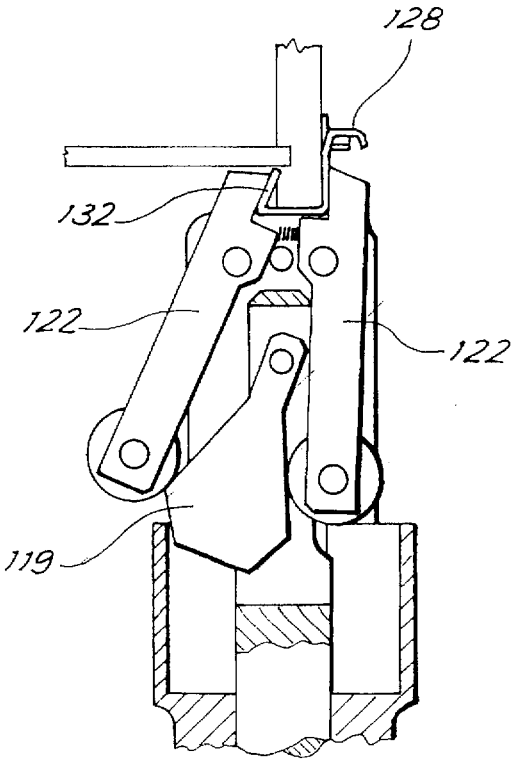
FIG. 7 shows a partial cutaway view of the clamping head of the tool of the FIG. 5 in a second operative position.

Alternatively, the support 133 of the pivots 123 can be made laterally movable and the wedge integral with the plunger, so as to maintain the relative movement between the slanted surfaces of the wedge and pivoting support of the levers, As can be clearly seen by comparing FIGS. 6 and 7, when the plunger is operated, thanks to the relative movement between wedge and lever support, the wedge 119 will rotate to a greater degree the lever which offers less resistance, that is to say, the lever which has its jaw 121 resting on the tab to be folded (more pliable than the opposite wall of the runner on which the other jaw rests). In other words, the jaw resting on the wall of the runner will remain substantially parallel to it, while the other will rotate until it clamps the tab.

Consequently, all the operator has to do is make sure that the clamping jaw is placed on the tab to be clamped.

In this way it is possible to clamp right-hand runners or left-hand runners without distinction, regardless of the direction of the tool, which consequently does not have to be rotated axially when switching from one runner to the next. Moreover, damage to the runner, caused by rotating the tool the wrong way, is averted.

It is obvious that with the tool made according to the invention it is possible to quickly clamp a runner by shifting the tool between the tabs to be folded for the complete clamping of the runner.

The foregoing description of embodiments applying the innovative principles of this invention is obviously given by way of example in order to illustrate such innovative principles and should not therefore be understood as a limitation to the sphere of the invention claimed herein. For example, the proportions between the various parts can vary according to practical necessity. Moreover, the actuator for operating the tool can differ from the one shown. For example, the operating trigger can be disposed in a different position if required for particular operating requirements. The broken line in FIG. 1 shows a possible specular position of the trigger. This possibility of double assembly of the trigger can be provided as a standard feature of the tool, so as to enable it to be used with the fixed jaw or with the movable jaw facing towards the operator, as required.

What is claimed is:

1. A clamping tool designed for clamping sheet metal runners onto the side panels of drawers, comprising a housing having thereon a clamp composed of s pair of jaws operable to grip and clamp a clamping area of a runner to the edge of a side panel of the drawer, a wedge-shaped element movable in a linear path toward and away from said clamp, a supporting element housing a pair of levers pivotally mounted intermediate their ends on said supporting element, and an actuator for pushing said wedge-shaped element toward the clamp to effect operation thereof, said jaws of the pair being made each on one end of each of said levers, and each lever having its other end slidingly resting on the wedge-shaped element, and means operative upon actuation of the actuator and sliding movement of the wedge-shaped element on said other ends of the levers to effect a relative lateral movement between the wedge-shaped element and the supporting element and consequent movement of either one of the jaws towards the other.

2. Tool as claimed in claim 1, characterized by the fact that each of said other ends of the levers slides over the wedge element with interposition of a sliding roller.

3. Tool as claimed in claim 1, characterized by the fact that the actuator moves against the thrust of a return spring.

4. Tool as claimed in claim 1, characterized by said housing comprising an elongated grippable casing, at one end of which is the clamp, the casing being internally provided with a plunger sliding towards the clamp to form said actuator.

5. Tool as claimed in claim 4, characterized by the fact that the actuator is operated by control of a valve operated by a trigger disposed on said casing.

6. Tool as claimed in claim 5, characterized by the fact that the trigger is disposed on said casing close to the end of the casing opposite the clamp.

7. Tool as claimed in claim 1 characterized by the fact that the levers are mounted in the housing in correspondence with grooves which at least partially open towards the outside of the housing in the plane of rotation of the levers.

8. Tool as claimed in claim 1, characterized by the fact that said means for effecting said relative lateral movement, comprises means mounting the wedge-shaped element for pivotal movement on a sliding element moved by the actuator in the direction of said clamp.

* * * * *